US011515076B2

(12) United States Patent
Sakaguchi

(10) Patent No.: US 11,515,076 B2
(45) Date of Patent: Nov. 29, 2022

(54) COIL DEVICE

(71) Applicant: HITACHI METALS LTD., Tokyo (JP)

(72) Inventor: Mutsuhito Sakaguchi, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 539 days.

(21) Appl. No.: 16/496,533

(22) PCT Filed: Mar. 23, 2018

(86) PCT No.: PCT/JP2018/011725
§ 371 (c)(1),
(2) Date: Sep. 23, 2019

(87) PCT Pub. No.: WO2018/180998
PCT Pub. Date: Oct. 4, 2018

(65) Prior Publication Data

US 2020/0381171 A1 Dec. 3, 2020

(30) Foreign Application Priority Data

Mar. 27, 2017 (JP) ..... JP2017-061681

(51) Int. Cl.

| | |
|---|---|
| ***H01F 17/04*** | (2006.01) |
| ***H01F 27/30*** | (2006.01) |
| ***H01F 27/02*** | (2006.01) |
| ***H01F 27/24*** | (2006.01) |
| ***H01F 27/28*** | (2006.01) |

(52) U.S. Cl.
CPC ..... *H01F 27/30* (2013.01); *H01F 27/02* (2013.01); *H01F 27/24* (2013.01); *H01F 27/2823* (2013.01)

(58) Field of Classification Search
CPC ..... H01F 27/30; H01F 27/02; H01F 27/24
USPC ..... 336/221
See application file for complete search history.

(56) References Cited

U.S. PATENT DOCUMENTS 4,311,978 A * 1/1982 Crockett ..... H01F 27/02 336/92
2013/0038415 A1* 2/2013 Ooishi ..... H01F 37/00 336/61

(Continued)

FOREIGN PATENT DOCUMENTS

CN 1230759 A * 10/1999 ..... H01H 50/042
CN 105075400 A * 11/2015 ..... H01F 27/02

(Continued)

OTHER PUBLICATIONS

International Search Report of PCT/JP2018/011725 dated Jun. 12, 2018 [PCT/ISA/210].

*Primary Examiner* — Elvin G Enad
*Assistant Examiner* — Joselito S. Baisa
(74) *Attorney, Agent, or Firm* — Sughrue Mion, PLLC

(57) ABSTRACT

A coil device comprising a pair of coil members annularly assembled at two connecting end portions; each coil member comprising a magnetic core, a resin case substantially entirely surrounding the magnetic core, and a coil wound around the resin case; the resin case having connecting means and guide means in the connecting end portion of each coil member; and the connected coil members being adhered to each other in the connecting end portions.

6 Claims, 7 Drawing Sheets

(56) References Cited

U.S. PATENT DOCUMENTS

| | | | | |
|---|---|---|---|---|
| 2013/0222100 | A1* | 8/2013 | Nomura | H01F 27/025 336/55 |
| 2015/0037926 | A1* | 2/2015 | Onicha | H01L 31/18 422/198 |
| 2015/0357117 | A1* | 12/2015 | Suzuki | H01F 27/263 29/605 |
| 2016/0233015 | A1* | 8/2016 | Nakatsu | H01F 37/00 |
| 2018/0358170 | A1* | 12/2018 | Hirabayashi | H01F 27/022 |

FOREIGN PATENT DOCUMENTS

| | | | | | |
|---|---|---|---|---|---|
| DE | 112007000624 | T5 | * | 2/2009 | H01F 27/266 |
| JP | 50-11016 | U | | 2/1975 | |
| JP | 03-117820 | U | | 12/1991 | |
| JP | 2013-115321 | A | | 6/2013 | |
| JP | 2013175565 | A | * | 9/2013 | |
| JP | 2013-243211 | A | | 12/2013 | |
| JP | 2017-103422 | A | | 6/2017 | |
| JP | 6458720 | B2 | * | 1/2019 | |

* cited by examiner

COIL DEVICE

CROSS REFERENCE TO RELATED APPLICATIONS

This application is a National Stage of International Application No. PCT/JP2018/011725, filed Mar. 23, 2018, claiming priority to Japanese Patent Application No. 2017-061681, filed Mar. 27, 2017.

FIELD OF THE INVENTION

The present invention relates to a coil device used for transformers, reactors, choke coils, etc., particularly to an annularly assembled coil device.

BACKGROUND OF THE INVENTION

Coil devices such as transformers, reactors, choke coils, etc. have conventionally been used in various applications such as home electric appliances, industrial appliances, vehicles, etc. A general coil device has a basic structure comprising a coil, an insulating resin bobbin around which the coil is wound, and a magnetic core arranged inside the bobbin.

The coil device has an annular structure as a whole, and the magnetic core constitutes a closed magnetic circuit. Among varied structures depending on the applications of the coil devices, some magnetic cores have annular structures constituted by assembling pluralities of divided members for easiness of winding wires around magnetic cores, etc.

For example, Japanese Utility Model Laid-Open Application 3-117820 discloses a rectangularly annular coil device constituted by assembling coil members each comprising a coil wound around an insulation case containing a magnetic core. FIG. 16 is a front view showing this coil device, with a partial cross section for easy understanding of the internal structure. FIG. 17 is a perspective view showing a coil member constituting the coil device.

The coil device comprises two assembled U-shaped magnetic cores 308 (308*a*, 308*b*). Each magnetic core 308 (308*a*, 308*b*) has a straight portion around which a coil is wound, and a bent portion extending in a direction crossing the longitudinal direction of the straight portion from both ends of the straight portion. The magnetic cores 308 (308*a*, 308*b*) are connected with their end surfaces 310 abutting each other to constitute the rectangularly annular magnetic core.

Each magnetic core 308 (308*a*, 308*b*) is received in each insulation case 301 (301*a*, 301*b*), and each coil 309*a*, 309*b* is wound around each case to constitute each coil member. The insulation case 301 (301*a*, 301*b*) has a partially opened hollow portion 311, in which the magnetic core 308 (308*a*, 308*b*) is received, with rear and side surfaces of the magnetic core 308 (308*a*, 308*b*) covered by the insulation case 301 (301*a*, 301*b*).

One insulation case 301*b* of the coil member has a projection 307 extending in the abutting direction, and the other insulation case 301*a* has a recess 306 for receiving the projection. The projection 307 comprises a thin-plate-shaped aim having a nail at its tip end, and the recess 306 acts as a fixing hole receiving the arm. Each insulation case 301 (301*a*, 301*b*) has a spring portion 315 pushing the magnetic core 308 (308*a*, 308*b*) toward the abutting surface 310.

With the nail at the tip end of the projection 307 engaging the fixing recess 306 to push the magnetic core 308 (308*a*, 308*b*) from rear toward the abutting surface 310, two coil members are integrally combined. Further, the coil members, the magnetic cores 308 (308*a*, 308*b*) and the insulation cases 301 (301*a*, 301*b*) are fixed by impregnation with varnish, to form the coil device.

Such structure can provide a coil device with easy coil winding and assembling. However, because the magnetic core is not entirely covered with the insulation case, high insulation is necessary between the coil and the magnetic core, when used for high-voltage, high-current reactors, etc.

Though the assembling of coil members is ensured by the engagement of the projections and recesses of the insulation cases, they are easily detached by an external force when not fixed by an adhesive such as varnish, etc., needing careful handling.

OBJECT OF THE INVENTION

Accordingly, an object of the present invention is to provide a coil device constituted by annularly assembling divided magnetic cores, which has improved insulation between coils and magnetic cores, and easiness in handling because the assembled coil members are not easily detached before adhering.

DISCLOSURE OF THE INVENTION

The present invention provides a coil device comprising a pair of annularly assembled coil members each comprising a coil arranged on a resin case containing a U-shaped magnetic core;

each of the coil members having connecting portions on both end sides of the magnetic core;

each of the connecting portions having a connecting part and a reinforcing part;

the reinforcing part being constituted by a gap between an inner wall of the resin case and an outer wall of the magnetic core, and a projection plate extending in the assembling direction of the coil members, a projection plate of one coil member being insertable into the gap of the other coil member; and the connecting part comprising a hook-shaped projection extending in the assembling direction and a projection receiver, the hook-shaped projection of one coil member being loosely fittable into the projection receiver of the other coil member.

The connecting portion of each coil member preferably has the hook-shaped projection of the connecting part on one side of the magnetic core, and the projection receiver on the other side, when viewed in the assembling direction, and further has a projection plate of the reinforcing part on the side of the projection receiver of the connecting part, and the gap on the side of the hook-shaped projection of the connecting part.

The positional relation between the hook-shaped projection and projection receiver of the connecting part in one connecting portion of the coil member is 180° inverse to that in the other connecting portion.

When the coil members are assembled, abutting portions of the opposing magnetic cores are preferably surrounded by the projection plates of the reinforcing parts.

The hook-shaped projection of the connecting part preferably has two arms, each arm having a hook-shaped portion at its tip end.

The resin case is constituted by two assembled case members, each case member receiving the magnetic core in its bottomed space.

The resin case preferably has flanges for positioning the coil.

EFFECT OF THE INVENTION

The present invention provides an easy-to-handle coil device constituted by annularly assembling divided magnetic cores to have improved insulation between coils and magnetic cores, whose coil members are not easily separated even before adhering.

BRIEF DESCRIPTION OF THE DRAWINGS

FIG. 1(*b*) is a front view showing an example of the coil devices of the present invention.

DESCRIPTION OF THE PREFERRED EMBODIMENTS

Figure 1A:
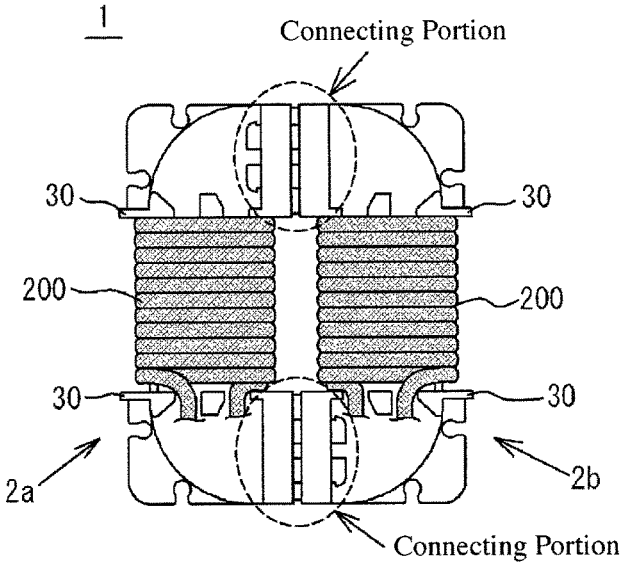
FIG. 1(*a*) is a plan view showing an example of the coil devices of the present invention.

The coil device according to an embodiment of the present invention will be specifically explained below, though the present invention is not restricted thereto. In part or all of the figures, portions unnecessary for explanation are omitted, and some portions are expanded or shrunken for easy explanation. Sizes and shapes shown for explanation, the relative positions of constituent members, etc. are not restricted to those shown in the figures, unless otherwise mentioned. In the explanations, the same names and reference numerals indicate the same or similar members, and the detailed explanations of some of those depicted are omitted.

Figure 1B:
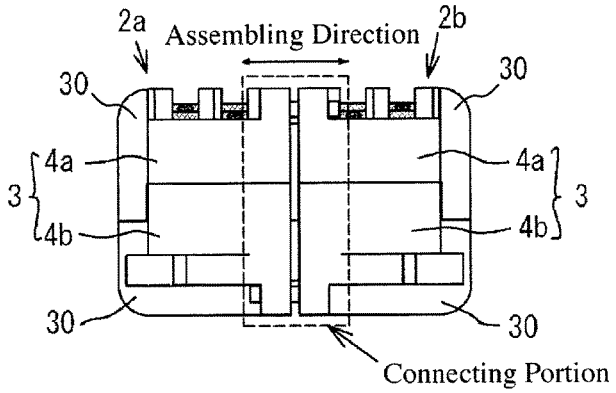
Figure 2:
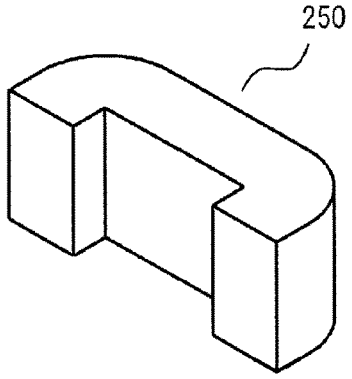
FIG. 2 is a perspective view showing an example of magnetic cores used in the coil device of the present invention.
Figure 3:
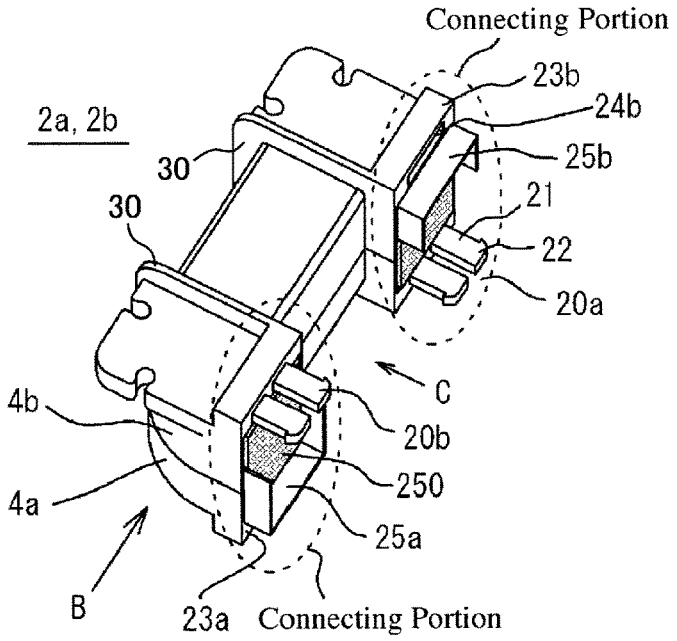
FIG. 3 is a perspective view showing a coil member constituting the coil device of the present invention.
Figure 4:
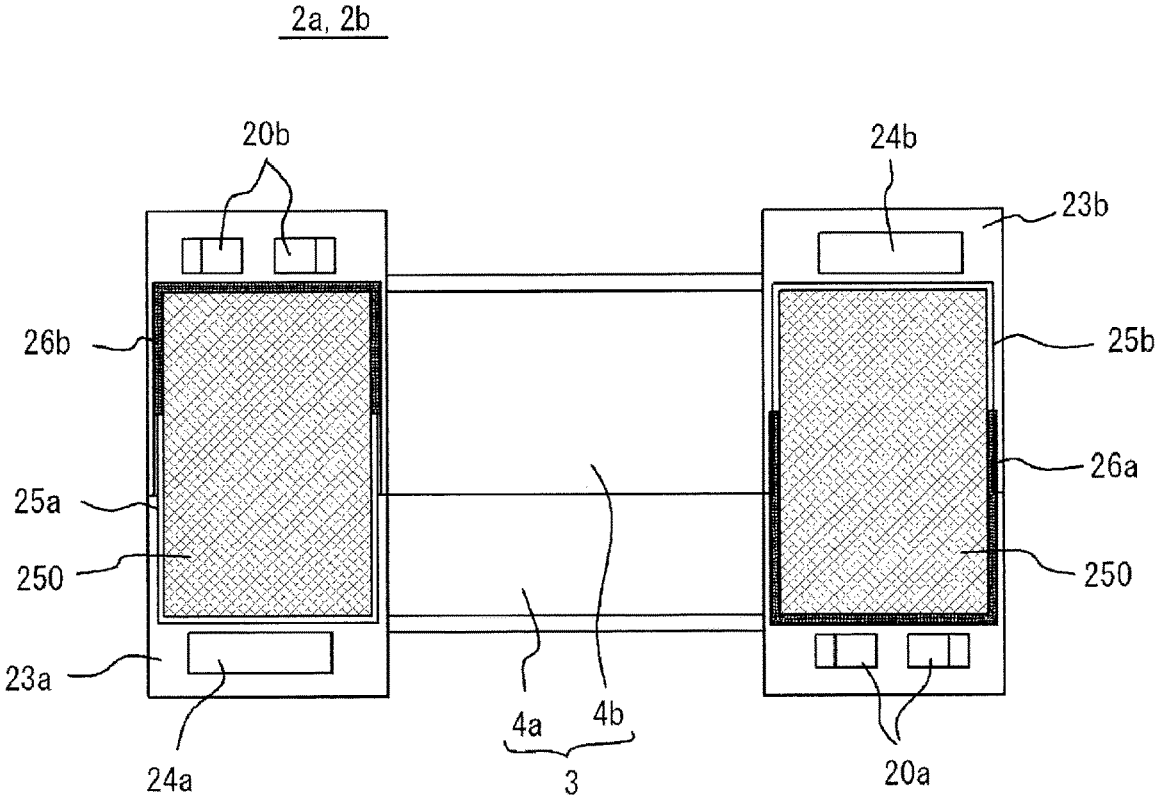
FIG. 4 is a right side view showing the coil member of FIG. 3 in a direction C.
Figure 5:
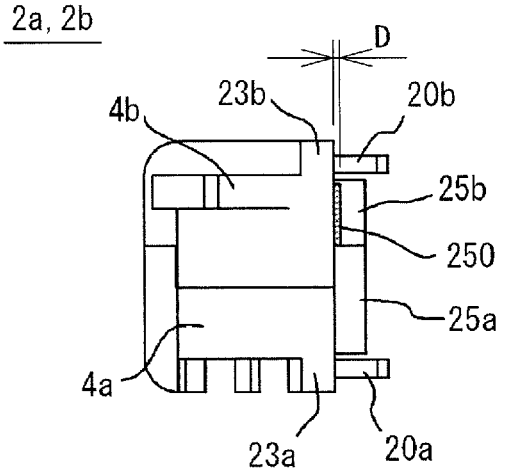
FIG. 5 is a front view showing the coil member of FIG. 3 in a direction B.
Figure 6:
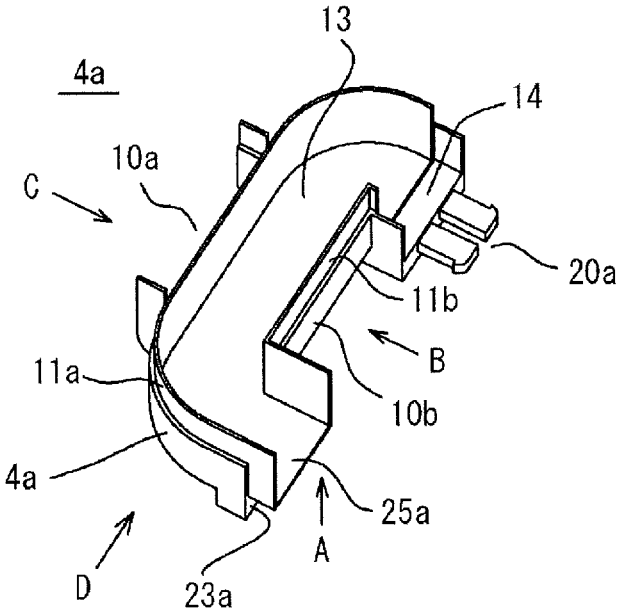
FIG. 6 is a perspective view showing a first case member constituting a resin case used in the coil device of the present invention.
Figure 7:
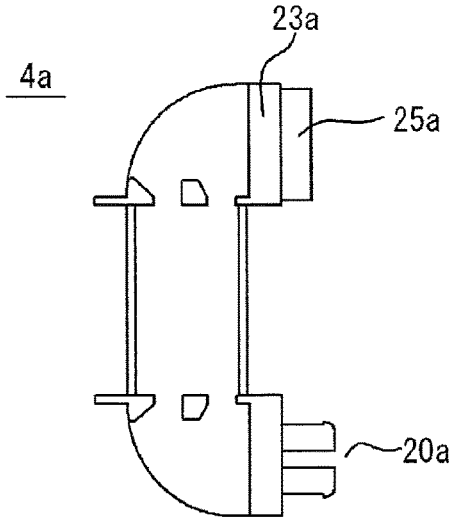
FIG. 7 is a bottom view showing the first case member of FIG. 6 in a direction A.
Figure 8:
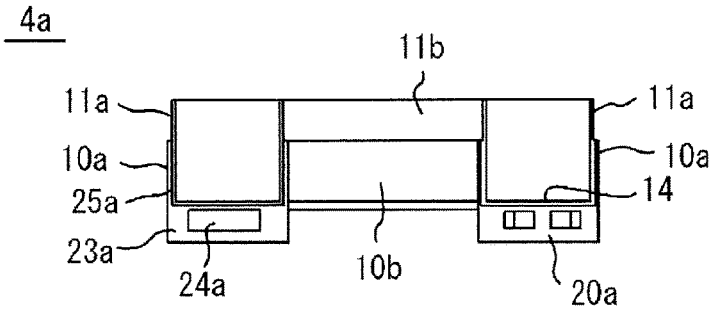
FIG. 8 is a right side view showing the first case member of FIG. 6 in a direction B.
Figure 9:
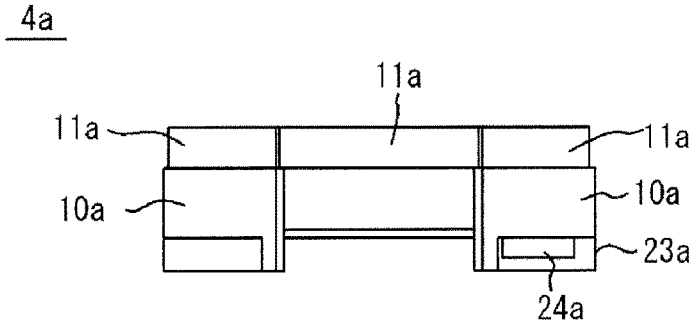
FIG. 9 is a left side view showing the first case member of FIG. 6 in a direction C.
Figure 10:
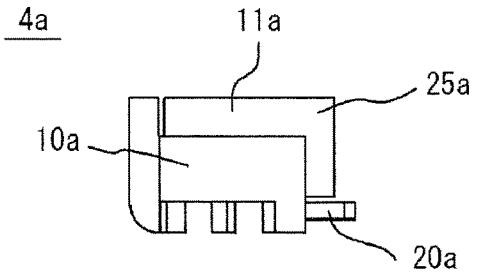
FIG. 10 is a front view showing the first case member of FIG. 6 in a direction D.
Figure 11:
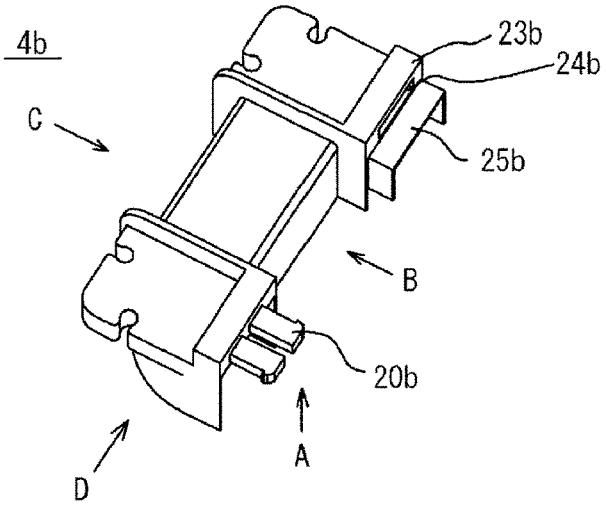
FIG. 11 is a perspective view showing a second case member constituting a resin case used in the coil device of the present invention.
Figure 12:
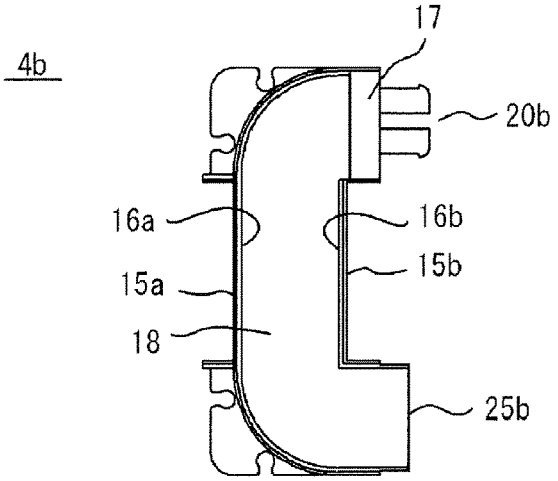
FIG. 12 is a bottom view showing the second case member of FIG. 11 in a direction A.
Figure 13:
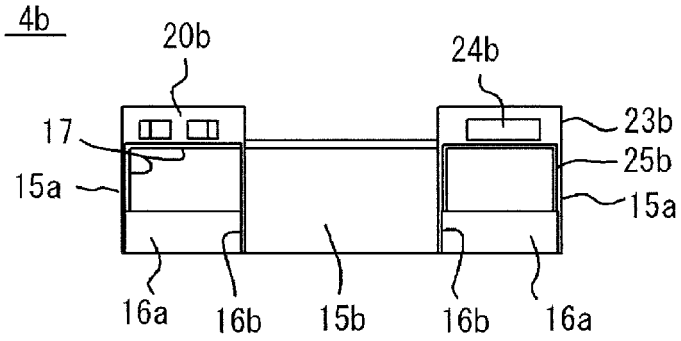
FIG. 13 is a right side view showing the second case member of FIG. 11 in a direction B.
Figure 14:
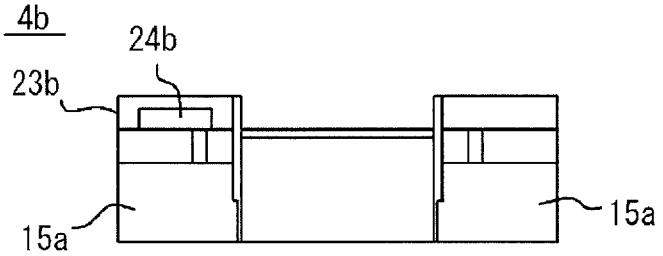
FIG. 14 is a left side view showing the second case member of FIG. 11 in a direction C.
Figure 15:
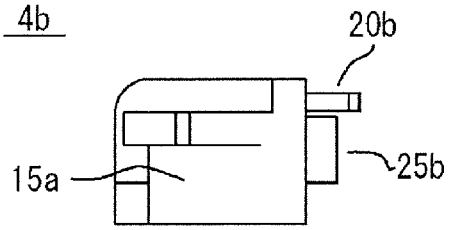
FIG. 15 is a front view showing the second case member of FIG. 11 in a direction D.
Figure 16:
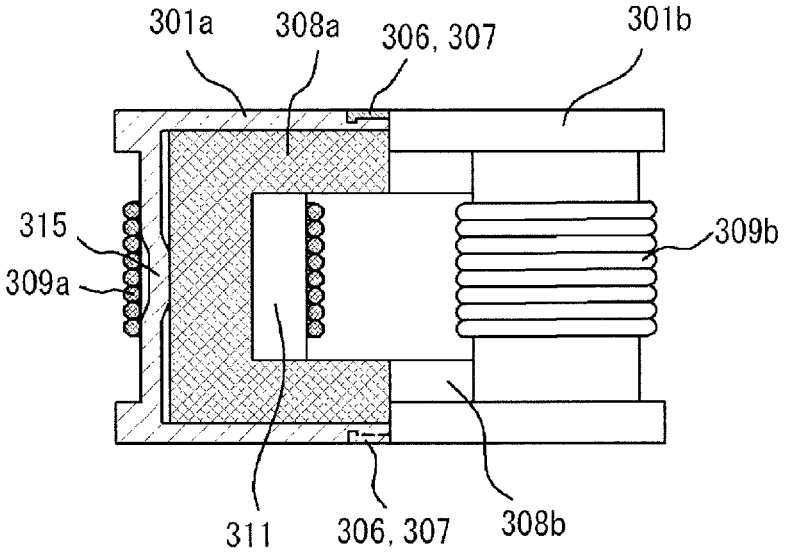
FIG. 16 is a front view showing an example of conventional coil devices.
Figure 17:
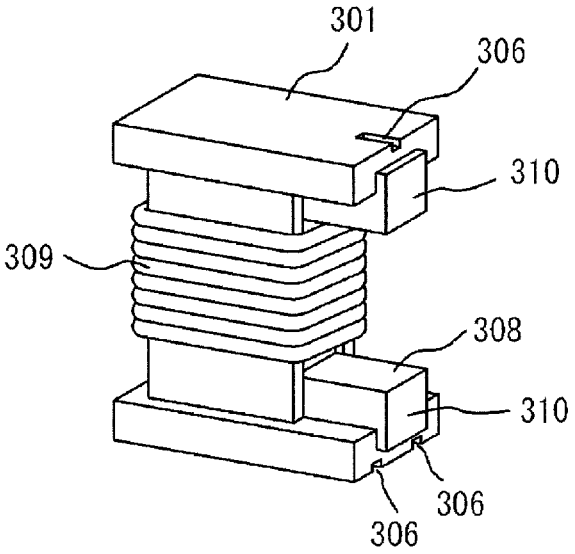
FIG. 17 is a perspective view showing a coil member constituting the conventional coil device.

FIG. 1(*a*) is a plan view showing an appearance of the coil device, and FIG. 1(*b*) is its front view. FIG. 2 is a perspective view showing an example of magnetic cores used in the coil device. FIG. 3 is a perspective view showing a coil member, FIG. 4 is a right side view showing the coil member in a direction C, and FIG. 5 is a front view showing it in a direction B. Incidentally, a coil is omitted in FIGS. 3, 4 and 5.

The coil device 1 of the present invention is constituted by assembled coil members 2*a*, 2*b*. Each coil member 2*a*, 2*b* comprises a magnetic core 250, a resin case 3 entirely enclosing the magnetic core, and a coil 200 wound around the resin case 3, the coil members 2*a*, 2*b* being assembled with their two connecting portions abutting each other and fixed by an adhesive, to constitute a rectangularly annular coil device 1. The coil 200 is wound around a straight portion between flanges 30.

As shown in FIG. 3, the straight portion between the flanges 30 has chamfered corners for easy winding of the conductor wire without damage. Each end portion of the coil 200 extends through a notch of the flange 30.

The coil 200 may be constituted by a single conductor wire or a flat, rectangularly cross-sectional conductor wire, which is coated with insulating enamel, or a Litz wire formed by several tens to hundreds of twisted, enameled, thin copper wires to have an increased conductor surface area to reduce temperature elevation by increased resistance due to skin effect. Because the coil member 2*a*, 2*b* has a shape making the winding of a coil easy, the type and number of winding of a conductor wire in the coil 200 are not restrictive, but may be selected depending on applications.

Though details are described below, the resin case 3 is constituted by assembling two case members 4*a*, 4*b*, and each case member 4*a*, 4*b* has a U-shaped, bottomed space partially receiving the magnetic core 250. The magnetic core 250 is placed in a space defined by assembled case members 4*a*, 4*b*, and the coil members 2*a*, 2*b* are assembled with the end surfaces of one magnetic core 250 and the other magnetic core 250 opposing each other. The magnetic cores 250 are entirely covered by the resin cases 3 for improved insulation between the coil 200 and the magnetic core 250.

The magnetic core 250 is preferably a magnetic core of Mn— or Ni— soft ferrite, or a dust magnetic core of crystalline or amorphous alloys such as Fe—Si alloys, Fe—Cr alloys, Fe—Cr—Si alloys, Fe—Al alloys, Fe—Al—Si alloys, Fe—Al—Cr alloys, Fe—Al—Cr—Si alloys, Fe—Ni alloys, Fe—M—B alloys, etc.

Each coil member 2*a*, 2*b* has two connecting portions each comprising a connecting part and a reinforcing part, on both end sides of the U-shaped magnetic core 250. Each connecting part is constituted by hook-shaped projections 20*a*, 20*b* integral with the resin case 3 and projection receivers 23*a*, 23*b*. Each reinforcing part is constituted by a gap 26*a*, 26*b* defined by an inner surface of the resin case and the magnetic core, and a projection plate 25*a*, 25*b* integrally extending from the resin case 3 in the assembling direction of the coil members 2*a*, 2*b*.

The connecting part and the reinforcing part will be explained in detail referring to FIGS. 3-5.

Connecting Part

Each hook-shaped projection 20*a*, 20*b* comprises an aim portion 21 extending in the assembling direction of the coil members 2*a*, 2*b*, and a hook-shaped portion at a tip end of the arm portion 21. Each projection receiver 23*a*, 23*b* is a wall-like portion of the resin case projecting in a direction perpendicular to the assembling direction, which comprises a hollow portion 24*a*, 24*b* engageable with a corresponding hook-shaped projection 20*a*, 20*b*. To assemble the coil members 2*a*, 2*b*, the hook-shaped projection 20*a* is loosely fit into the projection receiver 23*a*, and the hook-shaped projection 20*b* is loosely fit into the projection receiver 23*b*. The hook-shaped tip portions 22 of the hook-shaped projections 20*a*, 20*b* are inserted into the hollow portions 24*a*, 24*b* of the projection receivers 23*a*, 23*b*, to connect the coil members 2*a*, 2*b*.

As shown in FIG. 3, each hook-shaped projection 20*a*, 20*b* comprises a pair of arms 21 with a space therebetween, and hook-shaped portions 22 connected to their tip ends. A pair of arms 21 and a pair of hook-shaped portions 22 are respectively linearly symmetric with respect to a centerline of the space, though they may have different shapes. The hook-shaped projections 20*a*, 20*b* and the projection receivers 23*a*, 23*b* are not restricted to have the depicted shapes as long as they are engageable.

Reinforcing Portion

As shown in FIG. 4, there is a gap 26*a*, 26*b* between an inner surface of a thin portion of the resin case 3 (4*a*, 4*b*) and an outer surface of the magnetic core 250, on the end side of the magnetic core 250. In the figure, the gaps 26*a*, 26*b* are marked by black for clarity. As shown in FIG. 3, each projection plate 25*a*, 25*b* is a thin plate portion extending from the resin case 3 in the assembling direction of the coil members, slightly receding from an outer surface of the resin case 3. Each projection plate 25*a*, 25*b* is in a U shape when viewed in the assembling direction, such that it partially surrounds the magnetic core 250. A projection plate of one coil member can be inserted into the gap of the other coil member. Namely, the projection plate 25*a* is inserted into the gap 26*a*, and the projection plate 25*b* is inserted into the gap 26*b*, between the opposing coil members. In a state where the coil members 2*a*, 2*b* are assembled, abutting portions of the opposing magnetic cores 250 are surrounded by the projection plates 25*a*, 25*b* of the reinforcing parts, providing high strength to the connecting portions. Before the coil members 2*a*, 2*b* are adhered, the movement of the coil members can be limited in the assembling direction. As a result, cooperating with the connecting parts, the disconnection of the coil members 2*a*, 2*b* can be prevented during production.

The connection of the coil members 2*a*, 2*b* will then be explained. The hook-shaped portions 22 of the hook-shaped projections 20*a*, 20*b* of the connecting parts are put near the projection receivers 23*a*, 23*b*, and then inserted into the hollow portions 24*a*, 24*b* of the projection receivers 23*a*, 23*b*. The insertion elastically flexes the arm portions 21 to reduce their space, so that hook-shaped portions 22 enter the hollow portions 24*a*, 24*b*.

After the hook-shaped portions 22 pass through the hollow portions 24*a*, 24*b*, the space between the arm portions 21 expands to the original one, resulting in latching to connect the coil members 2*a*, 2*b*. Because the total width of the arm portions 21 including their space is slightly smaller than the width of each hollow portion 24*a*, 24*b*, the coil members 2*a*, 2*b* can be connected with loose engagement.

The hook-shaped projections 20*a*, 20*b* of the connecting parts are so long as to extend beyond the end surfaces of the projection plates 25*a*, 25*b* of the reinforcing parts. Accordingly, to assemble the coil members 2*a*, 2*b*, the projection plates 25*a*, 25*b* are inserted into the gaps 26*a*, 26*b* of the reinforcing parts, after the hook-shaped portions 22 of the hook-shaped projections 20*a*, 20*b* of the connecting parts are inserted into the hollow portions 24*a*, 24*b* of the opposing projection receivers 23*a*, 23*b*. Using the reinforcing parts as guides for loosely inserting the connecting parts, the projection plates are inserted into the gaps of the reinforcing parts formed in the connecting portions, so that the horizontal and vertical, relative positions of the magnetic cores 250 in two coil members 2*a*, 2*b* can be precisely and easily set to abut the end surfaces of the magnetic cores 250 for assembling, with high precision and little unevenness.

In the connecting portions of the coil members 2*a*, 2*b*, the hook-shaped projection 20*a*, 20*b* and the projection receiver 23*a*, 23*b* of each connecting part are positioned, such that the hook-shaped projection 20*a*, 20*b* is on one side of the magnetic core 250, while the projection receiver 23*a*, 23*b* is on the other side, when viewed in the assembling direction. Further, the projection plate 25*a* of the reinforcing part is on the side of the projection receiver 23*a* of the connecting part, while the projection plate 25*b* is on the side of the projection receiver 23*b*. The gap 26*a* of the reinforcing part is on the side of the hook-shaped projection 20*a* of the connecting part, while the gap 26*b* is on the side of the hook-shaped projection 20*b*.

The hook-shaped projections 20*a*, 20*b* and projection receivers 23*a*, 23*b* of the connecting parts of the coil members 2*a*, 2*b* are at 180°-inversed positions between one connecting portion and the other connecting portion. With such structure, the resin cases constituting a pair of coil members can have the same shape, resulting in the reduced number of parts, thereby lower production cost.

As shown in FIG. 5, end portions of the magnetic cores 250 slightly project at the connecting portions of the resin case 3 in the assembled coil members, such that the end surfaces of the magnetic cores 250 can abut each other. The projecting width D is preferably 0.5 mm or less. The reinforcing parts restrict the moving directions of the coil members, and the loose fitting of the connecting parts enables the use of common resin cases without necessitating different resin cases, even when the uneven sizes of the magnetic cores 250 provide different projecting widths D between the coil members, and even when an insulating spacer such as a resin film, a ceramic or oil paper, etc. is placed between the end surfaces of the magnetic cores 250 to constitute a magnetic gap. Also, an annular coil device whose gap may vary from 0 can be easily obtained regardless of a combination of coil members 2*a*, 2*b*.

The structure of the resin case will be explained in detail referring to the drawings. FIGS. 6-15 show the structure of the resin case, FIG. 6 being a perspective view showing one case member (first case member), FIG. 7 being a bottom view showing the first case member in a direction A, FIG. 8 being a right side view showing it in a direction B, FIG. 9 being a left side view showing it in a direction C, FIG. 10 being a front view showing it in a direction D, FIG. 11 being a perspective view showing the other case member (second case member), FIG. 12 being a bottom view showing the second case member in a direction A, FIG. 13 being a right side view showing it in a direction B, FIG. 14 being a left side view showing it in a direction C, and FIG. 15 being a front view showing it in a direction D.

As described above, the resin case is constituted by two case members, a first case member 4*a* and a second case member 4*b*. FIGS. 6-10 show the structure of the first case member. The first case member 4*a* receiving the magnetic core has a basic structure comprising a U-shaped space 13 having a bottom, from which an outer wall 10*a* and an inner wall 10*b* integrally extend upward. One end portion of the first case member 4*a* is provided with a projection receiver 23*a* of the connecting part and a projection plate 25*a* of the reinforcing part, while the other end portion is provided with a hook-shaped projection 20*a* and a receded step 14 for constituting the gap 26*a* of the reinforcing part. The outer wall 10*a* and inner wall 10*b* are provided with outer steps 11*a*, 11*b* for receiving the end portions of the second case member 4*b*. The outer steps 11*a*, 11*b* are continuous with the projection plate 25*a*, and their upper ends are connected at the same height.

FIGS. 11-15 show the structure of the second case member in detail. Like the first case member 4*a*, the second case member 4*b* has a basic structure comprising a U-shaped space 18 having a bottom, from which an outer wall 15*a* and an inner wall 15*b* integrally extend downward. The second case member 4*b* is also provided with a connecting part and a reinforcing part at both ends. One end portion is provided with a projection receiver 23*b* of the connecting part and a projection plate 25*b* of the reinforcing part, while the other end portion is provided with a hook-shaped projection 20*b* and a receded step 17 for constituting the gap 26*b* of the reinforcing part. Expanded corner portions are provided with four notches supporting end portions of the coil. The outer wall 15*a* and the inner wall 15*b* are provided with inner steps 16*a*, 16*b*. The walls are thin on the opening side of the bottomed space 18 and thick on the bottom side, to receive the end portions of the first case member 4*a*.

The positioning of the case members is conducted by combining the outer steps 11*a*, 11*b* of the first case member 4*a* with the inner steps 16*a*, 16*b* of the second case member 4*b*. Because the steps of the case members 4*a*, 4*b* are fit without gaps, the assembled resin case 3 has substantially no steps on its outer and inner surfaces.

The resin case is preferably formed by resins having excellent insulation, heat resistance, flexibility and moldability, specifically plastics such as polyphenylene sulfide, polyethylene terephthalate, ABS resins, engineering plastics, etc.

Because the annular assembling of divided magnetic cores easily provides a coil device with improved insulation between the coils and the magnetic cores while preventing easy separation of the coil members, the present invention can be applied to various coil devices.

What is claimed is:

1. A coil device comprising a pair of coil members each comprising a coil arranged on a resin case containing a U-shaped magnetic core, wherein the coil members are annularly assembled together to constitute the coil device;

each of said coil members having connecting portions on both end sides of said magnetic core;

each of said connecting portions having a connecting part and a reinforcing part;

said reinforcing part being constituted by a gap between an inner wall of the resin case and an outer wall of the magnetic core, and a projection plate extending in the assembling direction of the coil members, the projection plate of one coil member being insertable into the gap of the other coil member; and said connecting part comprising a hook-shaped projection extending in said assembling direction and a projection receiver, the hook-shaped projection of one coil member being loosely fittable into the projection receiver of the other coil member, wherein the connecting portion of each coil member has a hook-shaped projection of said connecting part on one side of said magnetic core, and said projection receiver on the other side, when viewed in the assembling direction, and further has a projection plate of said reinforcing part on the side of the projection receiver of said connecting part, and said gap on the side of the hook-shaped projection of said connecting part.

2. The coil device according to claim 1, wherein the positional relation between the hook-shaped projection and projection receiver of the connecting part in one connecting portion of said coil member is 180° inverse to that in the other connecting portion.

3. The coil device according to claim 1, wherein when the coil members are assembled, abutting portions of the opposing magnetic cores are surrounded by the projection plates of said reinforcing parts.

4. The coil device according to claim 1, wherein said hook-shaped projection of the connecting part has two arms, each arm having a hook-shaped portion at its tip end.

5. The coil device according to claim 1, wherein said resin case is constituted by two assembled case members, each of said case members receiving said magnetic core in its bottomed space.

6. The coil device according to claim 1, wherein said resin case has flanges for positioning said coil.

* * * * *